United States Patent [19]

Pleschiutschnigg et al.

[11] Patent Number: 4,976,306

[45] Date of Patent: Dec. 11, 1990

[54] COMBINED CONTINUOUS CASTING AND ROLLING

[75] Inventors: Fritz-Peter Pleschiutschnigg, Duisburg; Lothar Parschat, Ratingen; Armin Burau; Werner Rahmfeld, both of Muelheim; Gerd Moellers, Oberhausen; Hans-Juergen Ehrenberg, Duesseldorf; Hans G. Eberhardt, Duisburg, all of Fed. Rep. of Germany

[73] Assignee: Mannesmann AG, Duesseldorf, Fed. Rep. of Germany

[21] Appl. No.: 349,599

[22] Filed: May 9, 1989

[30] Foreign Application Priority Data

May 25, 1988 [DE] Fed. Rep. of Germany ..... 3818077

[51] Int. Cl.[5] ..... B22D 11/06; B22D 11/12

[52] U.S. Cl. ..... 164/476; 164/417

[58] Field of Search ..... 164/476, 417, 486, 459, 164/418, 442

[56] References Cited

U.S. PATENT DOCUMENTS

| | | | |
|---|---|---|---|
| 3,680,623 | 8/1972 | Tarmann et al. | 164/476 |
| 3,974,559 | 8/1976 | Kawawa et al. | 164/476 X |
| 4,010,792 | 3/1977 | Ishiguro et al. | 164/476 |
| 4,043,382 | 8/1977 | Saito et al. | 164/476 |
| 4,519,439 | 5/1985 | Fredriksson et al. | 164/476 |

*Primary Examiner*—Richard K. Seidel
*Assistant Examiner*—J. Reed Batten, Jr.
*Attorney, Agent, or Firm*—Ralf H. Siegemund

[57] ABSTRACT

A method for continuous casting metal products under utilization of a mold and pouring molten metal into the mold to obtain a flat stock with a thickness below 100 mm, includes withdrawing the partially solidified casting by at least one roll pair which reduce the thickness of the stock upstream from complete solidification by at least 10% but not more than 70% while further reduction in thickness by at least 30% obtains downstream from complete solidification is improved by requiring that the product being cast has a thickness not below 50 mm; that exclusively internally cooled rollers are used for obtaining the reduction; and that the thickness is reduced downstream from the complete solidification at a point where the temperature is only little below the solidus temperature particularly in the case of steel being a temperature between 1500 and 1200 degrees C.

8 Claims, 1 Drawing Sheet

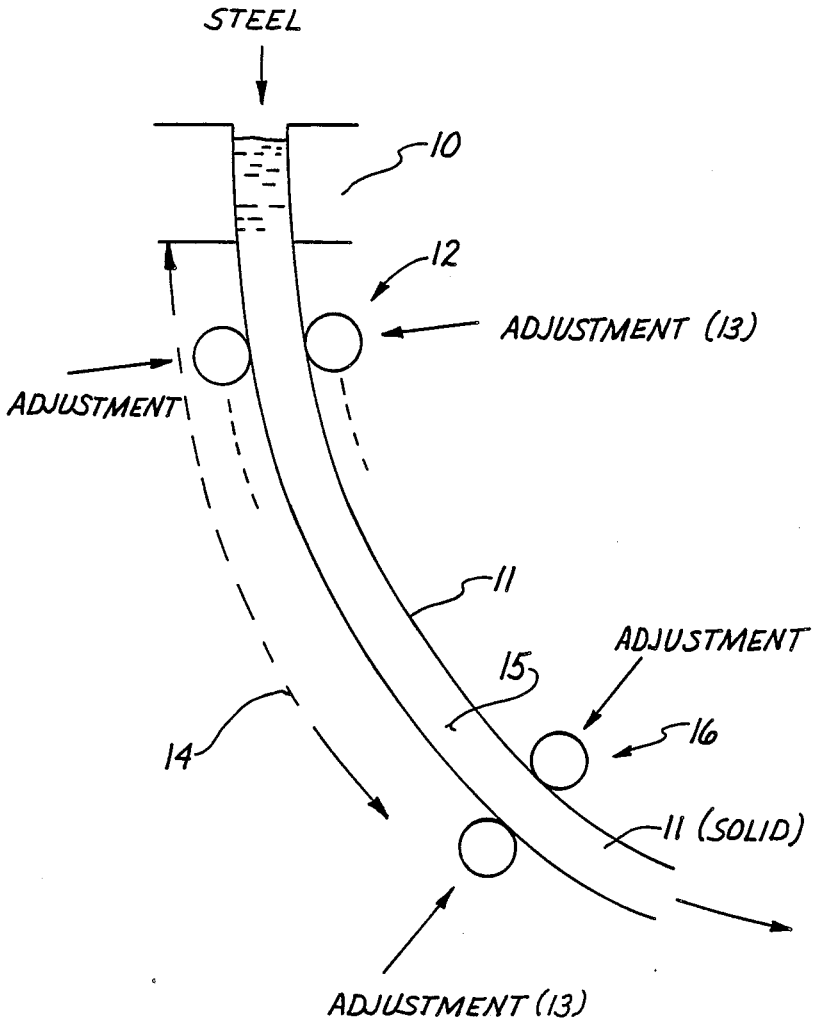
STEEL
10
12
ADJUSTMENT (13)
ADJUSTMENT
11
ADJUSTMENT
15
16
14
11 (SOLID)
ADJUSTMENT (13)

COMBINED CONTINUOUS CASTING AND ROLLING

BACKGROUND OF THE INVENTION

The present invention relates to a method of combining continuous casting and rolling of flat metal products, particularly products made of steel, and more particularly the invention relates to continuous roll casting of steel products under utilization of molten steel pouring into a mold from which emerges a casting of flat stock with a thickness under 100 mm, which casting is withdrawn as a partially solidified product under utilization of rolls which already reduce then and there the thickness of the flat stock in the solidification path the reduction being at least 10% but not more than 70% while a further reduction in thickness obtains by at least 30% right after completion of solidification.

Intermediate products resulting from a process outlined above are used as blanks for the further production of sheet stock, strips or the like. This intermediate product resulting from a combinaton of casting and rolling is also designated, thin slabs. Slabs which are too thick have exhibited certain separation problems of the alloying components particularly in the case of steel.

German printed patent application No. 24 44 443 prevents such precipitation and separation in that the casting is reduced while solidifying with emphasis on the point that the thickness reduction is to obtain just ahead of completion of solidification, with a reduction of 0.1 but not more than 2%. The European patent No. 286862 A1 discloses a manufacture of steel strip wherein the casting is reduced through compression before being rolled to obtain the final strip.

Recent developments have devoted efforts to match as close as possible the thickness of the cast ingot to the thickness of the final product. It is not possible to match these values completely but it is clear that one should come as close as is reasonably possible, to the dimensions of the final product in order to minimize as much as possible the extent of rolling of the casting. In order to meet this goal casting involves e.g. the casting of a flat product with between 40 and 50 mm thickness. The resulting flat product of course has a certain internal casting texture. Following the casting the product is moved out of the mold with transport rolls and cut into individual pieces which will be fed to an equalizing furnace and thereafter rolling obtains. This procedure is for example described in the journal "Stahl and Eisen" (Steel and Iron), 1988, vol. 3, pages 99 et seq. The method is disadvantaged by an indefinite casting texture as well as by the expenditure and equipment generally.

SUMMARY OF THE INVENTION

It is an object of the present invention to provide a new and improved method of combining rolling with casting so that the solidified product is already very close to the final dimension while particularly permitting coiling as the drawbacks outlined above are avoided.

It is another object of the present invention to improve a method of combined continuous casting and rolling to obtain stock of thickness below 100 mm, by reducing the thickness upstream from complete solidification by at least 10% but not more than 70% and downstream from that point of completed through-solidification a full reduction obtains by at least 30%.

In accordance with the preferred embodiment of the present invention it is suggested that the mold is to provide a flat product with a thickness between 50 and 100 mm which is then rolled by the transport rolls downstream from the mold to obtain the stated thickness reduction using essentially internally cooled roller pairs, while downstream from complete solidification reduction in thickness of at least 30% is provided close under the solidifying (solidus) temperature preferably between 1500 and 1200 degrees C. In furtherance of the invention it is suggested that the thickness reduction in the solidification path and the thickness reduction downstream from the solidification point are matched to each other so that the total reduction in thickness amounts to at least 60%. That means that the flat stock thus produced will not exceed 35 mm in thickness and it is therefore capable of being coiled. Hence, as a further step coiling may then obtain.

For improving surface quality it is furthermore proposed that the flat stock as emerging from the mold is prevented from scaling through surrounding it with scale avoiding atmosphere. This atmosphere should be maintained in the entire zone in which deformation is produced. For example, an inert gas such as nitrogen may be caused to surround and envelop the casting including the equipment for rolling and withdrawing. It may not be possible to house the entire equipment in that fashion then at least descaling is to be provided as a separate step. The desired fine grain texture obtains predominantly through the internal cooling of the rollers and rolls which hold the stock as it leaves the mold. On the other hand the rolls should be surface coated towards attenuating somewhat the cooling effect obtained by the rollers. The temperature range from 1500 to 1200 degrees C. was found advantageous of the final rolling towards obtaining an isotropic texture in the casting as rolled.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The figure illustrates schematically casting/rolling for practicing the preferred embodiment of the invention under best mode practice.

The invention should now be described briefly by way of example as shown in the figure. It is assumed that continuous casting is provided for in the vertical, with slight curvature in the mold 10 so that the casting 11 is veered with ease from the vertical to the horizontal beginning with the plane of the steel bath in the mold. It is furthermore assumed that the mold 10 provides a slab ingot 11 dimensioned by 60 mm by 1200 mm. The slab ingot 11 leaving the mold 10 has a solidified skin but the interior is still in the liquidous state. Roll pairs 12 grip the casting as it emerges and withdraw it from the mold pursuant to the continuous process at a rate of 3.5 m/minute. The roll pairs providing this transport are individually operated and controlled or handled in groups particularly as far as position vis-a-vis the casting is concerned; for thus adjustment 13 is provided.

Generally speaking the rolls 12 are forced against the casting 10 (adjustment 13) so that in the solidifying path, that means from the bottom level of the mold 10 down to the point 15 along the path 14 in which complete solidification has occurred, the casting 10 is reduced from 60 mm down to about 36 mm as far as thickness is concerned which is a 40% reduction as compared with the mold exit. Downstream from this reduction and from the solidifying point 15 further rolling pairs 16 are provided in which further reduction of thickness obtains namely from 36 to 25 mm obtains which is 30% down from the 36 mm value. Depending on the steel quality the deformation upstream from final solidification 15 as well as downstream may obtain through several rolls and pairs but of course one needs at least one pair upstream and one pair downstream from point 15. The flat product made in this fashion is finally coiled or further rolled in continuous process.

On the basis of the temperature particularly as it leaves the mold deformation obtains with fairly low expenditure in terms of machine equipment. It should be noted that rollers are needed anyway for withdrawing a casting. To convert them into rolls is comparatively easy and not expensive in terms of equipment cost. A flat product obtains which already on leaving has a fine grain texture corresponding to usual rolling procedure. Such a material can therefore be coiled with ease.

Moreover, it was surprisingly found that the strength and ductility properties of the product made in this fashion even though the deformation is relatively small match those closely of the final product to be made.

The invention is not limited to the embodiments described above but all changes and modifications thereof, not constituting departures from the spirit and scope of the invention, are intended to be included.

We claim:

1. Method for continuous casting utilizing a mold and pouring molten metal into the mold to obtain a flat stock with a thickness below 100 mm and including withdrawing the flat stock by means of at least one roll pair, the flat stock being partially solidified, and reducing by means of said rolls the thickness of the stock upstream from the point of complete solidification by at least 10% but not more than 70% of the thickness of the flat stock; and providing further reduction in thickness of the flat stock by at least 30% downstream from the point of complete solidification to obtain a final product, the improvement comprising:

the flat stock having a thickness not below 50 mm;

using exclusively internally cooled rollers for reducing the flat stock; and reducing the thickness of the flat stock downstream from the point of complete solidification but at a point where the temperature is only little below the solidus temperature.

2. Method as in claim 1, wherein the total reduction in thickness is adjusted to provide the final product of not more than 35 mm thickness.

3. Method as in claim 1, including the step of coiling the final product.

4. Method as in claim 1, wherein the total reduction in thickness through upstream and downstream rolling is at least 60%.

5. Method as in claim 1, including preventing the formation of scaling.

6. Method as in claim 1, including descaling the final product.

7. Method as in claim 1, wherein said rollers are surface coated.

8. Method as in claim 1, the temperature at the point being, in the case of steel, between 1500 and 1200 degrees C.

* * * * *